United States Patent [19]

Brncick et al.

[11] Patent Number: 5,074,060

[45] Date of Patent: Dec. 24, 1991

[54] ATHLETIC SHOE TOE PROTECTOR

[76] Inventors: Michael D. Brncick, 890 Kurt La., Crete, Ill. 60417; William D. Moritz, Jr., 13313 W. RedCoat, Lemont, Ill. 60439

[21] Appl. No.: 502,184

[22] Filed: Mar. 30, 1990

[51] Int. Cl.[5] ..... A43C 13/14

[52] U.S. Cl. ..... 36/77 R; 36/72 R

[58] Field of Search ..... 36/61, 62, 64, 65, 72 R, 36/77 R

[56] References Cited

U.S. PATENT DOCUMENTS

| | | | |
|---|---|---|---|
| 536,812 | 4/1895 | Mabee | 36/72 R |
| 1,053,024 | 2/1913 | Fritzsche | 36/72 R |
| 1,118,755 | 11/1914 | Fiscus | 36/77 R |
| 2,007,728 | 7/1935 | Ranauro | 36/72 R |
| 2,325,741 | 8/1943 | Chertok | 36/72 R |
| 2,747,303 | 5/1956 | Abrahams | 36/72 R |
| 2,949,912 | 8/1960 | Shapiro | 36/72 R |
| 3,310,889 | 10/1963 | Samuels | 36/72 R |
| 3,481,055 | 9/1968 | Herman | 36/72 R |
| 4,051,612 | 10/1977 | Damron | 36/72 R |
| 4,103,438 | 8/1978 | Fron | 36/72 R |
| 4,177,583 | 12/1979 | Chapman | 36/77 R |
| 4,333,248 | 6/1982 | Samuels | 36/72 R |

FOREIGN PATENT DOCUMENTS

| | | | |
|---|---|---|---|
| 2127275 | 4/1984 | United Kingdom | 36/72 R |

OTHER PUBLICATIONS

National Safety News, vol. 115, No. 2, pp. 45–47, "Toe, Foot, and Leg Protection" (Feb. 1977).

*Primary Examiner*—Paul T. Sewell
*Assistant Examiner*—Marle D. Patterson
*Attorney, Agent, or Firm*—Juettner Pyle & Lloyd

[57] ABSTRACT

A toe protector for removable attachment to an athlete's shoe is disclosed. The toe protector comprises a semirigid shell substantially enclosing the distal portion of the athletic shoe, providing protection for the athlete's toes, without unduly interfering with normal biomechanical range of motion. The shell has dorsal, plantar, medial and lateral portions. The proximal end of the dorsal portion terminates in a curved line following the proximal ends of the athlete's proximal phalanges. The proximal end of the medial and lateral portions terminate at about the proximal one-third point of the athlete's first and fifth metatarsals, respectively. The proximal end of the plantar portion covers the athlete's metatarsal heads. The shell is attached to the athletic shoe with a T nut fastener, attaching the plantar portion of the shell to the sole of the shoe at a point proximal to the athlete's metatarsal heads.

15 Claims, 2 Drawing Sheets

ATHLETIC SHOE TOE PROTECTOR

BACKGROUND OF THE DISCLOSURE

This invention relates to toe protectors or guards for protecting a person's toes from injury, protecting a previous injury from aggravation, or protecting the toe portion of a shoe from wear. The invention is particularly well suited for use in athletics, e.g., for protecting a baseball player's toes from injury.

It is well known that toe and foot injuries frequently occur in many sports, including for example, baseball, football and soccer. As a result, various athletic to and instep protectors have been designed for the purpose of preventing such injuries. See for example, U.S. Pat. No. 4,333,248, issued June 8, 1982 to Samuel Samuels and U.S. Pat. No. 3,481,055, issued Dec. 2, 1969 to Pinkey Herman. These prior protectors have not been entirely satisfactory, however, for the reason that they tend to restrict biomechanical motion of the athlete's foot. In athletics, particularly at the professional level, it is necessary to maintain unrestricted biomechanical motion of the foot and toes.

Excessive wear of shoes can also be a problem. For example, children may drag their toes along the ground when riding skate boards. Toe dragging can cause rapid and severe wear to a child's shoe.

In the prior art, the devices for attaching toe protectors to shoes has not been entirely satisfactory. Compare, for example, Samuels U.S. Pat. No. 3,310,889 where the protector is stitched to the shoe and Samuels U.S. Pat. No. 4,333,248 wherein the protector is attached to the shoe with a zipper. There has been a need for a toe protector that can be securely attached, and yet be easily removed from the shoe.

OBJECT OF THE INVENTION

It is an object of the invention to provide a toe protector of sufficient rigidity to deflect impact normally encountered in athletics, such as baseball.

It is a further object of the invention to provide a toe protector that does not unduly inhibit the normal full range of biomechanical motion of the foot and toes.

It is third object of the invention to provide a toe protector that is light in weight yet strong and durable.

It is a fourth object of the invention to provide an attachment means that will securely attach the protector to the shoe so that it will not come off, yet be easily and quickly removed when desired.

It is a final object of the invention to provide a toe protector that may be utilized with minimum modification to the athletic shoe.

SUMMARY OF THE INVENTION

In accordance with the basic embodiment of the present invention, a toe protector for removable attachment to an athletic shoe is provided. The toe protector comprises a semirigid shell substantially enclosing the distal portion of the athletic shoe. The shell is preferably molded from plastic, to be shock resistant, light in weight and durable.

The distal end of the shell is trimmed to specific contours so as to protect the athlete's toes without interfering with normal biomechanical range of motion. Specifically, the shell has dorsal, medial and lateral portions. The proximal end of the dorsal portion terminates in a curved line substantially following the proximal ends of the athlete's proximal phalanges. Thereby, the shell covers and protects the athlete's phalangeal area, but does not restrict biomechanical motion at the phalangeal—metatarsal articulation. The proximal ends of the medial and lateral portions terminate at about the proximal one-third point of the athlete's first and fifth metatarsal, respectively. Accordingly, the medial and lateral portions of the shell covers the athlete's phalangeal area and about two-thirds of the athlete's metatarsal. In combination, the dorsal, medial and lateral contours permit free movement at the metatarsal—phalangeal joints, allowing without interference, normal pronation —supination range of motion 40 to 45 degrees. The lateral and medial contours also allow for forefoot motion at the tarsal—metatarsal joint, which provides for 10 degrees of abduction and about 20 degrees of adduction range of motion.

Alternatively, if protection of the athlete's proximal phalangeal area is not necessary, the proximal end of the dorsal portion of the shell may be trimmed in a curved line following an extension of the proximal ends of the middle phalanges. This will permit free movement at the athlete's proximal inter-phalangeal articulation. Similarly, if protection of the athlete's middle phalangeal area is not necessary, the proximal end of the dorsal portion of the shell may be trimmed in a curved line following an extension of proximal ends of the distal phalanges. Free movement of the distal inter-phalangeal articulation will result.

The interior of the shell is sized to receive the toe of the athletic shoe and to provide sufficient space to permit free movement of the athlete's proximal and distal inter-phalangeal joints.

In a first embodiment of the invention, the shell includes a plantar portion. The proximal end of the plantar portion of the shell extends in a proximal direction to about the mid-point of the athlete's metatarsals. It extends in a distal direction to beyond the distal phalanges to serve as a rigid lever arm for the phalanges to push against during the 30–35 degree range of motion at the proximal and distal inter-phalangeal joints. The plantar portion of the shell may also include openings for receiving any spikes of the athletic shoe.

In the first embodiment, the shell is attached to the athletic shoe with a T nut fastener. The fastener attaches the plantar portion of the shell to the sole of the shoe at a point proximal from the athlete's metatarsal-phalangeal articulation. Preferably the attachment point is about 1.5 cm proximal to the athlete's metatarsal head. The attachment point does not interfere with the normal 70 degree pronation— supination range of motion of the forefoot. An additional fastener may be provided at any convenient location in a distal direction from the first fastener. The athletic shoe need only be modified by the provision of small holes for receiving the fasteners. Thereby the protector may be securely attached and easily removed.

In a second embodiment of the invention, the shell does not include a plantar portion, thereby providing an opening for the sole of the shoe to engage the ground. This embodiment is desirable for court shoes, running shoes or other applications where interference with the sole of the shoe is unnecessary or unacceptable. In the second embodiment, the shell is preferably attached to the shoe with a hook and loop tape fasteners (e.g., Velcro ® fastener). The loop portion of the tape is secured by adhesive to the lower edge of the inner surface of the shell. The hook portion of the tape is secured with an adhesive to the corresponding front and side edges of the shoe. The protective shell may be quickly and easily secured and removed from the shoe.

Accordingly, the protector of the invention provides for a semirigid shell for defecting impact to the athlete's toes, does not interfere with normal range of motion at any of the athlete's tarsal, metatarsal or phalangeal joints, is securely attached to the athlete's shoe, may be removed quickly and easily, and does not require significant modification of the athletic shoe. Further objects and advantages of the present invention will become apparent in reference to the following detailed description when considered with the accompanying drawings.

DETAILED DESCRIPTION

Figure 1:
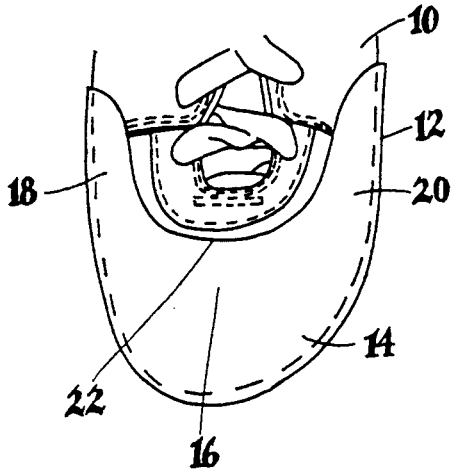
FIG. 1 is vertical plan view of the toe protector of the invention attached to an athletic shoe.
Figure 2:
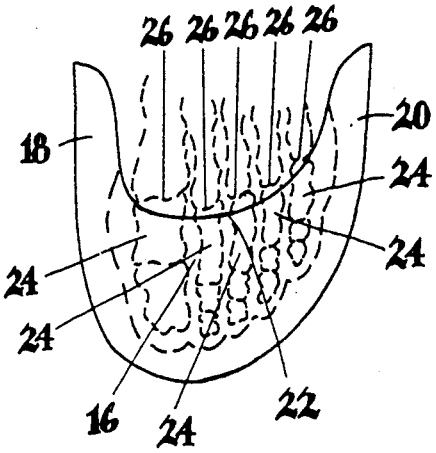
FIG. 2 is a vertical plan view of the toe protector of the invention, showing the protector in relation to the bone structure of an athlete's foot.

Referring now to the drawings, FIGS. 1 through 4 illustrate the basic embodiment of the invention. FIG. shows the front or toe portion of an athletic shoe 10. Attached to the shoe 10 is a toe protector 12 of the invention. The toe protector comprises a shell 14 substantially enclosing the toe portion of the shoe 10. The shell 14 has dorsal 16, medial 18 and lateral 20 portions. The proximal end 22 of the dorsal portion 16 terminates in a curved line substantially following the proximal ends of the athlete's proximal phalanges 24. Thereby, the shell covers and protects the athlete's phalangeal area, but does not restrict biomechanical motion at the phalangeal—metatarsal articulation 26.

Figure 3:
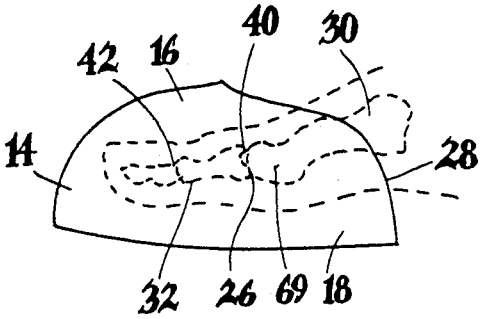
FIG. 3 is a side view of the medial side of the toe protector of the invention, showing the protector in relation to the first ray or big toe of an athlete's foot.

As best shown in FIG. 3, the proximal end 28 of the medial portion 18 of the shell 14 terminates at approximately the one-third proximal point of the athlete's first metatarsal 30. Thereby, the shell covers the medial side of the athlete's phalangeal area 32 and about two-thirds of the athlete's first metatarsal 30.

Figure 4:
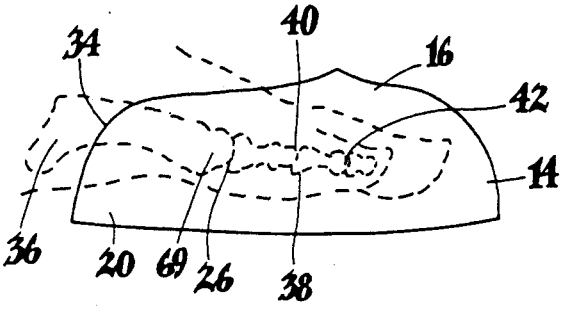
FIG. 4 is a side view of the lateral side of the toe protector of the invention, showing the protector in relation to the fifth ray or little toe of an athlete's foot.

Turning now to FIG. 4, the proximal end of 34 of the lateral portion 20 of the shell 14 terminates at about the proximal one-third point of the athlete's fifth metatarsal 36. Accordingly, the lateral portion 20 of the shell 14 protects the athlete's phalangeal area 38 and about two-thirds of the athlete's fifth metatarsal 36.

The interior of the shell 14 is sized to receive the toe of the athletic shoe 10. As shown in FIGS. 3 and 4, the shell 14 is sufficiently spaced from the athlete's foot to allow free movement of the athlete's proximal 40 and distal 42 inter-phalangeal joints.

Figure 5:
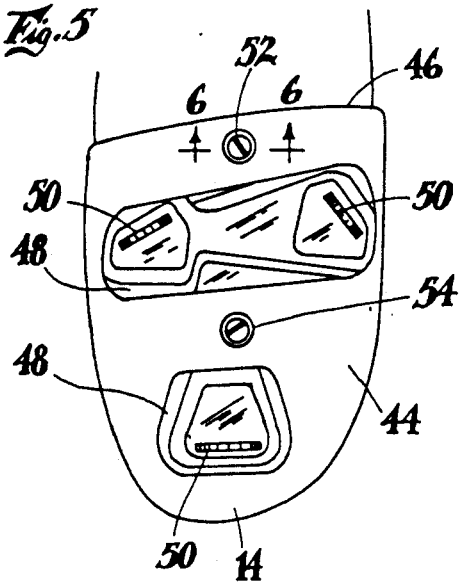
FIG. 5 is bottom plan view of a first embodiment of the toe protector of the invention as attached to a baseball shoe.
Figure 6:
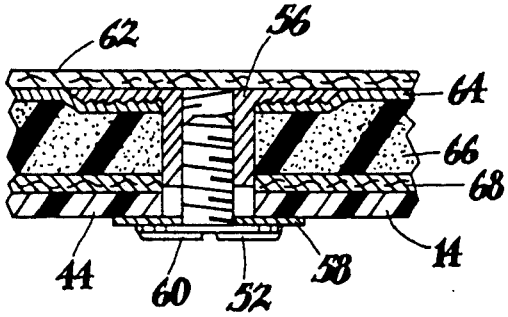
FIG. 6 is a cross sectional view of the toe protector of the invention taken along line 6—6 of FIG. 5, showing an attachment fastener of the first embodiment.
Figure 7:
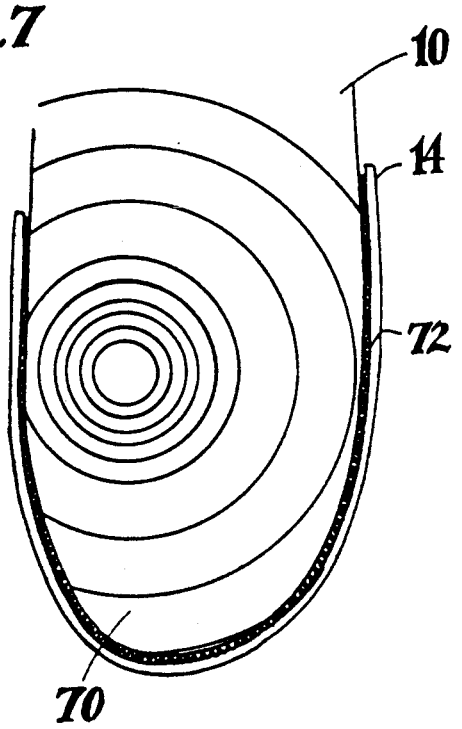
FIG. 7 is a bottom plan view of a second embodiment of the toe protector of the invention as attached to a tennis shoe.

A first embodiment of the invention is shown in FIGS. 5 and 6. In the first embodiment, the shell 14 includes a plantar portion 44. The proximal end 46 of the plantar portion of the shell extends in a proximal direction to cover the athlete's metatarsal heads 69. Openings 48 are provided in the plantar surface 44 to receive any spikes 50 of the athletic shoe. In FIG. 5, baseball spikes 50 are shown.

In the first embodiment, the shell 14 is attached to the athletic shoe with T nut fasteners 52 and 54. The fasteners 52 and 54 comprise a nut 56, burr 58 and screw 60. The fasteners 52 and 54 are secured by first removing the insole 62 and then drilling a hole though the various layers of the sole of the shoe 64, 66 and 68. The nut 56 and screw 60 are long enough to engage each other, but sufficiently short so as not to extend into the plantar portion of the athlete's foot. The burr 58 spreads the load of the screw 60 to the plantar portion 44 of the shell 14.

Ideally, the screw 52 is located about 1.5 cm proximal to the athlete's metatarsal head 69. The attachment point does not interfere with the normal 70 degree pronation—supination range of motion of the forefoot. An additional fastener 54 may be provided at any convenient location in a distal direction from the first fastener 52.

Figure 8:
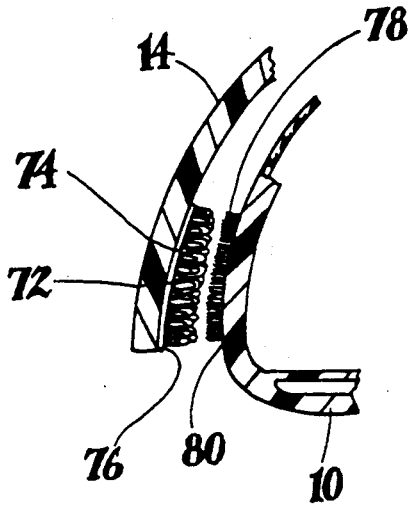
FIG. 8 is a cross sectional view of the toe protector of the invention taken along line 8—8 of FIG. 7, showing the attachment fastener of the second embodiment.
Figure 9:
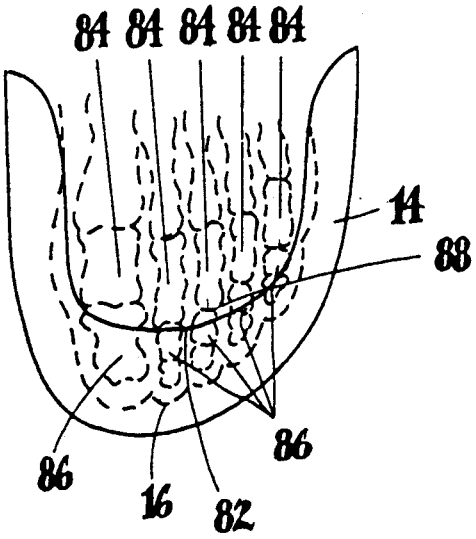
FIG. 9 is top plan view of the invention similar to FIG. 2 showing an alternative dorsal trim line.

A second embodiment of the invention is depicted in FIGS. 8 and 9. In the second embodiment, the shell 14 does not include a plantar portion. Thus, as shown in FIG. 8, the sole athletic shoe 70 is not covered or otherwise obstructed. In the second embodiment, the shell is preferably attached to the shoe with hook and loop tape fasteners 72 (e.g., Velcro ® fastener). The loop portion 74 of the tape is secured by adhesive to the lower edge 76 of the inner surface of the shell 14. The hook portion 78 of the tape is secured with an adhesive to the corresponding edges 80 of the shoe 10.

FIG. 9 shows an alternative dorsal trim line 82 of shell 14. If protection of the athlete's proximal phalangeal area 84 is not necessary, the proximal end 82 of the dorsal portion 16 of the shell 14 may be trimmed in a curved line following the proximal ends of the middle phalanges 86. This will permit free movement at the athlete's proximal inter-phalangeal articulation 88.

Figure 10:
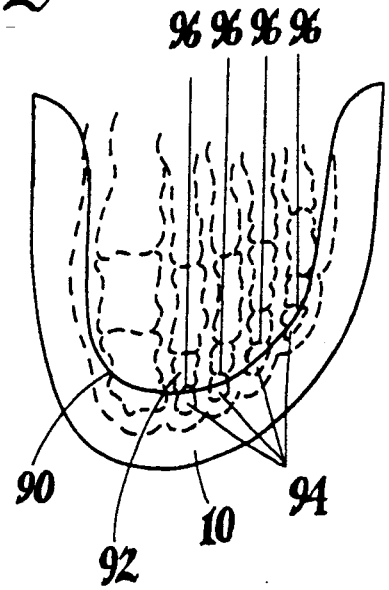
FIG. 10 is a top plan view of the invention similar to FIGS. 2 and 9 showing another alternative dorsal trim line.

FIG. 10 shows another alternative dorsal trim line 90. If protection of the athlete's middle phalangeal area 92 is not necessary, the proximal end 90 of the dorsal portion 16 of the shell 14 may be trimmed in a line following the proximal ends of the distal phalanges 94. Free movement of the distal inter-phalangeal articulation 96 will result.

The shell portion 14 of the toe protector 12 of the invention is formed of plastic by vacuum molding process. First, an impression is made of the front or distal portion of the athletic shoe 10 on which the toe protector 12 is desired. The impression may be made with an alginate compound. The shoe is prepared for molding by stuffing the toe with felt to retain its shape. The shoe is then preferably sprayed with a silicon release agent to protect the shoe and aid in the release of the shoe from the alginate compound. The compound is mixed. The shoe is inserted into the compound. The compound is allowed to cure. After the compound is cured, the felt is removed from the toe, the toe is collapsed, the spikes are released, and the shoe is removed from the alginate compound.

The next step is to form a model of the shoe. Preferably a dental grade plaster is used. The plaster is mixed, poured into the alginate mold and tapped to remove air bubbles. A pipe is inserted into the plaster to serve as a handle. After the plaster has set, the model is removed from the mold. Any excess material is trimmed away. The model is then coated with varnish to serve as a moisture barrier.

The next step is the molding process. Preferably a double layer of nylon fabric is stretched over the model to assist in the vacuum molding process and in the removal of the finished plastic shell from the model. The model is mounted on a vacuum forming platform. A sheet of plastic, preferably a 12 inch by 12 inch square of high density polyethylene, is mounted in a molding frame and placed in an oven. The plastic is heated until it is sufficiently soft and pliable. Then, the plastic sheet is pulled down over the model, and stretched to seat on the platform. A vacuum is then applied to pull the plastic against the model. The plastic is then allowed to cool.

The next step in the process is to remove the plastic shell from the model. The dorsal, medial, lateral and plantar trim contours ar then cut with a utility knife in accordance with the invention. Openings may also be cut into the plantar surface of the shell for receiving the spikes of the athletic shoe.

Other molding process may be used to form the shell of the invention. It is believed that injection molding processes may be favorable for commercial production of toe protectors of the invention.

The final step in the process is to attach the shell 14 to the athletic shoe 10. In the case of the first embodiment, the shell is preferably attached to the shoe with two T nuts 52 and 54. The location for the two nuts is first marked on the shell. Holes are then drilled into the shell. The insole of the shoe is removed. The shell is placed over the shoe. The location for the holes is marked on the shoe. The corresponding holes may then be drilled into the shoe. Preferably the T nuts are seated into the inside sole of the shoe. The insole is placed back into the shoe. The shell is placed back onto the shoe. And, the two screw are secured.

In the second embodiment, the shell 14 is attached to the shoe 10 with a hook and loop tape fastener 72. The plantar portion of the shell is removed with a utility knife. Then, the loop portion 74 of the tape is secured with an adhesive to the interior, bottom edge of the shell 76. The hook portion 78 of the tape is then secured with an adhesive to the corresponding edge surface of the shoe 80. The shell may then be placed over the shoe so as to engage the hook and loop portions of the fastener.

While the preferred embodiments of the invention have been shown and described in detail, it is to be appreciated that various modifications, other embodiments and uses thereof may be derived by one skilled in the art without departing from the spirit and scope of the invention as defined by the appended claims.

What is claimed is:

1. A toe protector for protecting a person's toes, adapted to be removably attached to a shoe, the person's toes having metatarsal-phalangeal joints, the protector comprising a semirigid shell substantially enclosing the distal portion of said shoe, said shell having a dorsal portion, the proximal end of said dorsal portion terminating in a smooth asymmetrically curved edge, said curved edge being substantially parallel to and spaced in a distal direction from a smooth curved line connecting the person's metatarsal-phalangeal joints; and means for removably attaching said shell to said shoe.

2. A toe protector as in claim 1, wherein said asymmetrically curved edge of said dorsal portion is adjacent the proximal ends of each of the person's proximal phalanges.

3. A toe protector as in claim 1, wherein said shell has a medial portion, the proximal end of said medial portion terminating in an edge at about the proximal one-third point of the person's first metatarsal.

4. A toe protector as in claim 1, wherein said shell has a lateral portion, the proximal end of said lateral portion terminating in an edge at about the proximal one-third point of the person's fifth metatarsal.

5. A toe protector as in claim 1, wherein said shell has a plantar portion, the proximal end of said plantar portion termination in an edge at about the mid-point of each of the person's metatarsals.

6. A toe protector as in claim 5, wherein the said shoe has at least one cleat, and the plantar portion of said shell having at least one opening therein of receiving said cleat.

7. A toe protector as in claim 5, wherein said means for attaching comprises at least one fastener, said fastener attaching said plantar portion of said shell to the sole of said shoe.

8. A toe protector as in claim 7, wherein one said fastener is proximal to the athlete's metatarsal phalangeal articulation.

9. A toe protector as in claim 7, wherein said at least one fastener comprises a T nut and screw.

10. A toe protector as in claim 1, wherein said means for removably attaching comprises a hook and loop tape, one side of said tape being secured to the inner surface of said shell and the other side of said tape being secured to the corresponding surface on said shoe.

11. A toe protector for protecting a person's toes, adapted to be removably attached to a shoe, the person's foot having five metatarsals and five corresponding proximal phalanges, the protector comprising a semirigid shell substantially enclosing the distal portion of said shoe, said shell having a dorsal, medial, lateral and plantar portions, the proximal end of said dorsal portion terminating in a smooth asymmetrically curved edge adjacent each of the proximal ends of the person's proximal phalanges, the proximal end of said medial portion terminating in and edge adjacent the proximal one-third point of the person's first metatarsal, the proximal end of said lateral portion terminating in an edge adjacent the proximal one-third point of the person's fifth metatarsal, the proximal end of said plantar portion terminating in an edge adjacent the mid-point of each of the person's metatarsals; and means for fastening said plantar portion of said shell to the sole of said shoe at a point proximal to the person's proximal phalanges.

12. A toe protector as in claim 11, wherein said shoe has at least one cleat, and the plantar portion of said shell having at least one opening therein for receiving said cleat.

13. A toe protector as in claim 11, wherein said shell is a unitary member molded from high density polyethylene.

14. A toe protector for protecting a person's toes, adapted to be removably attached to a shoe, the person's foot having five metatarsals and five corresponding proximal phalanges, the protector comprising a semirigid shell substantially enclosing the distal portion of said shoe, said shell having a dorsal, medial and lateral portions, said shell having an opening for the plantar portion of said shoe, the proximal end of said dorsal portion terminating in a smooth asymmetrically curved edge adjacent each of the proximal ends of the person's proximal phalanges, the proximal end of said medial portion terminating in and edge adjacent the proximal one-third point of the person's first metatarsal, the proximal end of said lateral portion terminating in an edge adjacent the proximal one-third point of the person's fifth metatarsal; and means for fastening said shell to said shoe.

15. A toe protector as in claim 14, wherein said fastening means comprises a hook and loop tape, one side of said tape being secured to the inner surface of said shell and the other side of said tape being secured to the corresponding surface on said shoe.

* * * * *